US008438794B2

(12) United States Patent
Eickhof

(10) Patent No.: US 8,438,794 B2
(45) Date of Patent: May 14, 2013

(54) COLUMBARIUM CONSTRUCTION AND SHUTTER MOUNTING SYSTEM

(75) Inventor: Paul Eickhof, Crookston, MN (US)

(73) Assignee: Eickhof Columbaria, Inc., Crookston, MN (US)

( * ) Notice: Subject to any disclaimer, the term of this patent is extended or adjusted under 35 U.S.C. 154(b) by 0 days.

(21) Appl. No.: 13/375,803

(22) PCT Filed: Sep. 10, 2010

(86) PCT No.: PCT/US2010/048481

§ 371 (c)(1),
(2), (4) Date: Dec. 2, 2011

(87) PCT Pub. No.: WO2012/033499

PCT Pub. Date: Mar. 15, 2012

(65) Prior Publication Data

US 2012/0167488 A1 Jul. 5, 2012

Related U.S. Application Data

(63) Continuation-in-part of application No. 12/476,529, filed on Jun. 2, 2009, now Pat. No. 8,122,650.

(51) Int. Cl.
*E04H 13/00* (2006.01)

(52) U.S. Cl.
USPC ..... 52/134; 52/136; 52/139; 52/483.1; 52/510; 52/513

(58) Field of Classification Search ..... 52/128, 52/133, 134, 136, 139, 483.1, 510, 511, 513; 312/265.5, 265.6, 140, 245
See application file for complete search history.

(56) References Cited

U.S. PATENT DOCUMENTS

| | | | | |
|---|---|---|---|---|
| 3,266,207 | A * | 8/1966 | Birum, Jr. | 52/459 |
| 3,561,182 | A * | 2/1971 | Madl, Jr. | 52/479 |
| 3,888,055 | A * | 6/1975 | Gallo | 52/98 |
| 4,644,711 | A * | 2/1987 | Eickhof | 52/127.11 |
| 4,899,508 | A * | 2/1990 | Biebuyck | 52/235 |
| 5,195,812 | A * | 3/1993 | Eickhof | 312/257.1 |
| 5,802,781 | A * | 9/1998 | Eickhof | 52/136 |
| 5,979,124 | A * | 11/1999 | Branan | 52/136 |
| 8,051,623 | B2 * | 11/2011 | Loyd | 52/747.1 |
| 8,122,650 | B2 * | 2/2012 | Eickhof | 52/134 |
| 8,245,457 | B2 * | 8/2012 | Eickhof | 52/134 |

* cited by examiner

*Primary Examiner* — William Gilbert
*Assistant Examiner* — Gisele Ford
(74) *Attorney, Agent, or Firm* — Larkin Hoffman Daly & Lindgren, Ltd.; Thomas J. Oppold

(57) ABSTRACT

A columbarium having a framework of a plurality of horizontally spaced vertical risers and a plurality of vertically spaced horizontal members defining a plurality of niches arranged in substantially horizontal rows and substantially vertical columns. Each of the horizontal members has a substantially planar web extending between a front rail and a back flange. A plurality of shutters is removably mounted over the plurality of niches by a concealed mounting system. The concealed mounting system permits the shutters to be movable about three axes of rotation as well as vertically and horizontally with respect to the horizontal members.

20 Claims, 8 Drawing Sheets

COLUMBARIUM CONSTRUCTION AND SHUTTER MOUNTING SYSTEM

CROSS-REFERENCE TO RELATED APPLICATIONS

For purposes of the United States, this application is a continuation-in-part of U.S. patent application Ser. No. 12/476,529, filed Jun. 2, 2009.

BACKGROUND

Stone shutters are removably secured to columbarium structures by a mounting system that is preferably substantially concealed or substantially hidden from view so as not to detract from the appearance of the stone and the reverent atmosphere of the columbarium. The concealed mounting system must resist corrosion and it must securely hold the shutters in position despite extreme temperature swings and countless freeze-thaw cycles for season-after-season and year-after-year, for decades, if not centuries. In addition, the mounting system must permit the shutters to be relatively easily removed and replaced even after years or decades of being exposed to the elements.

U.S. Pat. No. 4,644,711 to Eickhof discloses one type of concealed shutter mounting system that meets all of the foregoing challenges. Variations of the Eickhof '711 concealed shutter mounting system have achieved significant commercial success in the columbarium industry. However, a simpler and more cost effective concealed fastener system is needed in view of the recent trend away from using large 24"×24" stone panels and toward the use of 8"×8" individual niche shutters. The terms "shutter," "panel," "slab" and "facing stone" are used interchangeably throughout this specification.

A standard columbarium niche is 8"×8". Until relatively recently, it was common to use 24"×24" stone slabs with false joints cut into the finish face of the stone slab to simulate nine 8"×8" individual niche shutters. Each of the nine 8"×8" spaces on the large panel is typically engraved with a the name, birth year and death year of the deceased person whose urn resides behind that 8"×8" space. Thus, each time an urn is to be placed into one of the nine niches, or each time one of the nine niches is to be engraved, the entire 24"×24" stone panel has to be removed and then replaced. A typical 24"×24" stone panel weighs about sixty pounds. Because of the potential for misspelling of names or errors in the birth or death dates during each time the panel is engraved, it is not uncommon to have to discard and replace an entire panel due to a single mistake made when engraving one of the nine niches. Accordingly, it should be appreciated that large panels are not only difficult to handle by a single person due to their size and weight, but the use of large panels can be expensive if the panels need to be replaced due to engraving errors.

As a result of the foregoing concerns with the use of 24"×24" panels, a relatively recent trend in the columbarium industry is to use 8"×8" individual niche panels. These smaller panels are easier to handle during initial installation and when they need to be subsequently removed for engraving or when placing an urn within the niche. If there is ever an engraving error, only the single 8"×8" panel needs to be replaced instead of the entire 24"×24" panel. It should be appreciated, however, that when going from one large panel to nine smaller individual panels, all other things being equal, the amount of individual hardware pieces required to mount the panels will necessarily increase as will the amount of material costs and labor costs associated with the initial assembly of the panels and the initial mounting of the panels.

Accordingly, there is a need in the industry for a universal concealed mounting system capable of use with virtually any size columbarium shutters, but which has fewer pieces and is quicker and easier to assemble and install then currently available mounting systems in order to reduce material costs and labor costs so that even the use of smaller individual 8"×8" shutters is at least as cost effective as using larger 24"×24" panels mounted with currently available mounting systems.

Heretofore, columbaria structures have been constructed using a variety of different materials and techniques. For example, some columbarium structures have been constructed using cast-in-place or precast concrete to form the niches. Other columbarium structures have been constructed entirely from aluminum members welded or bolted together to form the niches. While each of these types of construction may serve the intended purpose, both construction types are costly and time consuming. U.S. Pat. No. 5,195,812 to Eickhof (hereinafter "the '812 patent") discloses a columbarium structure that is comprised of a framework of vertical risers and horizontal shelves secured together by brackets and tie-rods to form the niches. The '812 patent discloses that the vertical risers are constructed of cement fiberboard and the plastic shelves are constructed of extruded plastic. The '812 patent discloses that the back of the niches are closed off by large cement fiberboard panels secured by rivets or screws to the back flange of the extruded horizontal shelves. The framework of niches is then secured to a supporting wall or another bank of niches. The type of framework construction disclosed in the '812 patent has proven to be very commercially successful due to the savings in labor, time and materials over previous construction methods because the framework is comprised of relatively light weight prefabricated members designed to easily fit together for quick assembly while still providing a durable and quality appearance.

Some customers, however, viewed the use of plastic shelves as being of lesser quality and it was also found that the dimension tolerances of the extruded plastic shelves could not be satisfactorily controlled, impeding the assembly process. As a result, as disclosed in co-pending U.S. patent application Ser. No. 12/476,529 to Eickhof (hereinafter "the '529 application"), the extruded plastic shelves were replaced with cement fiberboard. While cement fiberboard shelves provide a more high quality appearance than plastic shelves, they are much heavier and therefore more expensive to ship and more difficult to lift and handle. Furthermore, with the use of a cement fiberboard shelf, both a front rail and a back rail are necessary to support the shelf and to provide the necessary surface area on which to secure the cement fiberboard to enclose the back of the niches and to support the stone facing at the front of the niche. Accordingly, there is a need for a columbarium construction that provides the features and advantages of the framework system disclosed in the '812 patent and which provides the higher quality appearance disclosed in the '529 application, but which is lighter weight for easier handling, which reduces shipping costs, and which reduces handling and labor costs for assembly.

Furthermore, although the concealed mounting system disclosed in the '529 application was a significant improvement over previous concealed mounting systems, the mounting system disclosed in the '529 application did not permit in-and-out adjustment of the shutters or facing stones. As a result, if there was even a minor variation in thickness of the facing stones, it was difficult to adjust the stones in-and-out to provide a smooth or flush wall surface. Furthermore, with the mounting system of the '529 application, when a facing stone was removed, unless it was replaced exactly in the original location the vertical gap between adjacent stones would be inconsistent and detract from the appearance of the columbarium unless time was taken to adjust the facing stone to correct the gap or spacing between the adjacent stones. Additionally, some customers prefer a columbarium structure with a relief pattern in the facing stones. Accordingly, it is desirable to provide a concealed mounting system that can accommodate different stone thicknesses and to permit in-and-out adjustment so the facing stones can be easily placed with the desired relief pattern in the wall. It is also desirable to provide a mounting system, that will allow the facing stones to be replaced in the same location so as to ensure spacing between the stones remains uniform without having to adjust the stones after they are replaced.

DESCRIPTION

Figure 1:
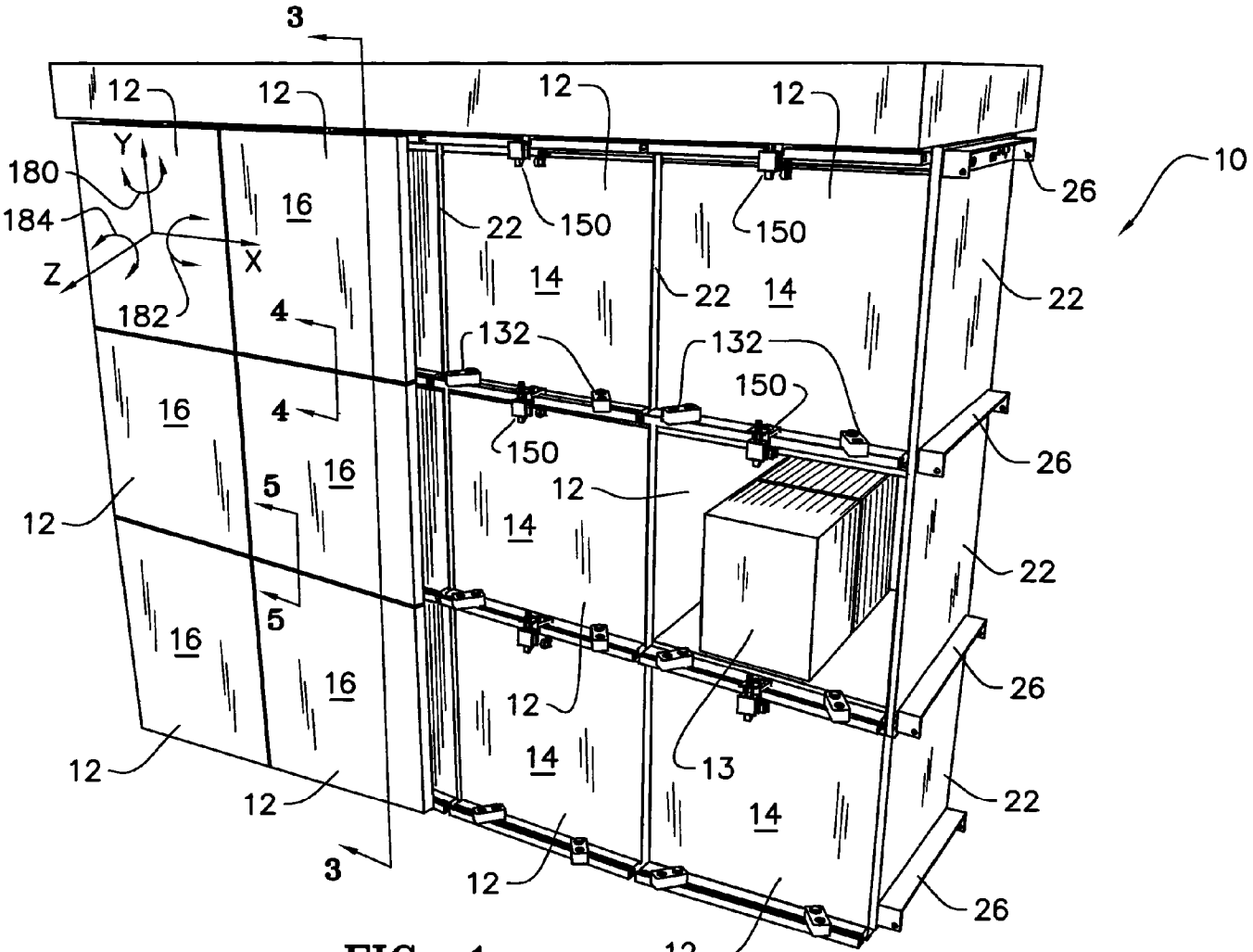
FIG. 1 is a perspective view of a columbarium comprising a plurality of niches, wherein some of the niches are open, some are shown with inner closure panels disposed over the front opening, and other niches are shown with shutters mounted utilizing an embodiment of a concealed mounting system cooperating with an embodiment of the horizontal member.

Referring now to the drawings, wherein like reference numerals designate identical or corresponding parts throughout the several views, FIG. 1 is a perspective view of a columbarium 10 comprising a plurality of niches 12 which may hold one or more urns 13. Some of the niches 12 are shown open, some are shown with inner closure panels 14 disposed over the niche opening, and other niches 12 are shown with shutters or facing stones 16 secured over the closure panels 14 utilizing a concealed mounting system 100 as described in detail later.

The columbarium 10 preferably comprises a framework 20 of horizontally spaced, vertical, planar risers 22 and vertically spaced, horizontal shelves 24. As disclosed in U.S. Pat. No. 5,195,812 to Eickhof (hereinafter "the '812 patent") and in pending U.S. application Ser. No. 12/476,529 (hereinafter "the '529 application"), both of which are incorporated herein in their entirety by reference, shelf brackets 26 and tie rods 28 (best viewed in FIG. 3) secure the vertical risers 22 and horizontal shelves 24 in spaced relation to define a grid of a plurality of niches 12. However, unlike the systems disclosed in the '812 patent or in the '529 application, in the embodiment of the present invention (discussed in greater detail later), the horizontal shelves 24 are preferably comprised of a single horizontal member 200 that includes a front rail 202 and a back flange 204 joined by a planar web 206 (best viewed in FIG. 3). As discussed in detail later, the front rail 202 cooperates with the concealed mounting system 100 to adjustably support the shutters or facing stones 16. The back flange 204 provides a surface to which the back wall 32 is secured by rivets or threaded connectors. It should be appreciated that the large section modulus of the horizontal member 200 (resulting from the front rail 202, back flange 204 and web 206) provides substantial lateral and longitudinal stability when the framework structure 20 is tied together with the tie rods 28.

The horizontal member 200 is preferably fabricated from extruded aluminum, but may be fabricated from pultruded fiber reinforced polymer ("FRP") or any other suitably rigid, weather resistant, and dimensionally stable, extrudable or pultrudable materials. The dimensions of the horizontal member 200 may vary depending on the desired size of the niches 12, the span between risers 22, any anticipated static or dynamic loading conditions, the overall dimensions of the framework 20 and the support structure (if any) to which the framework 20 is to be secured.

Figure 2:
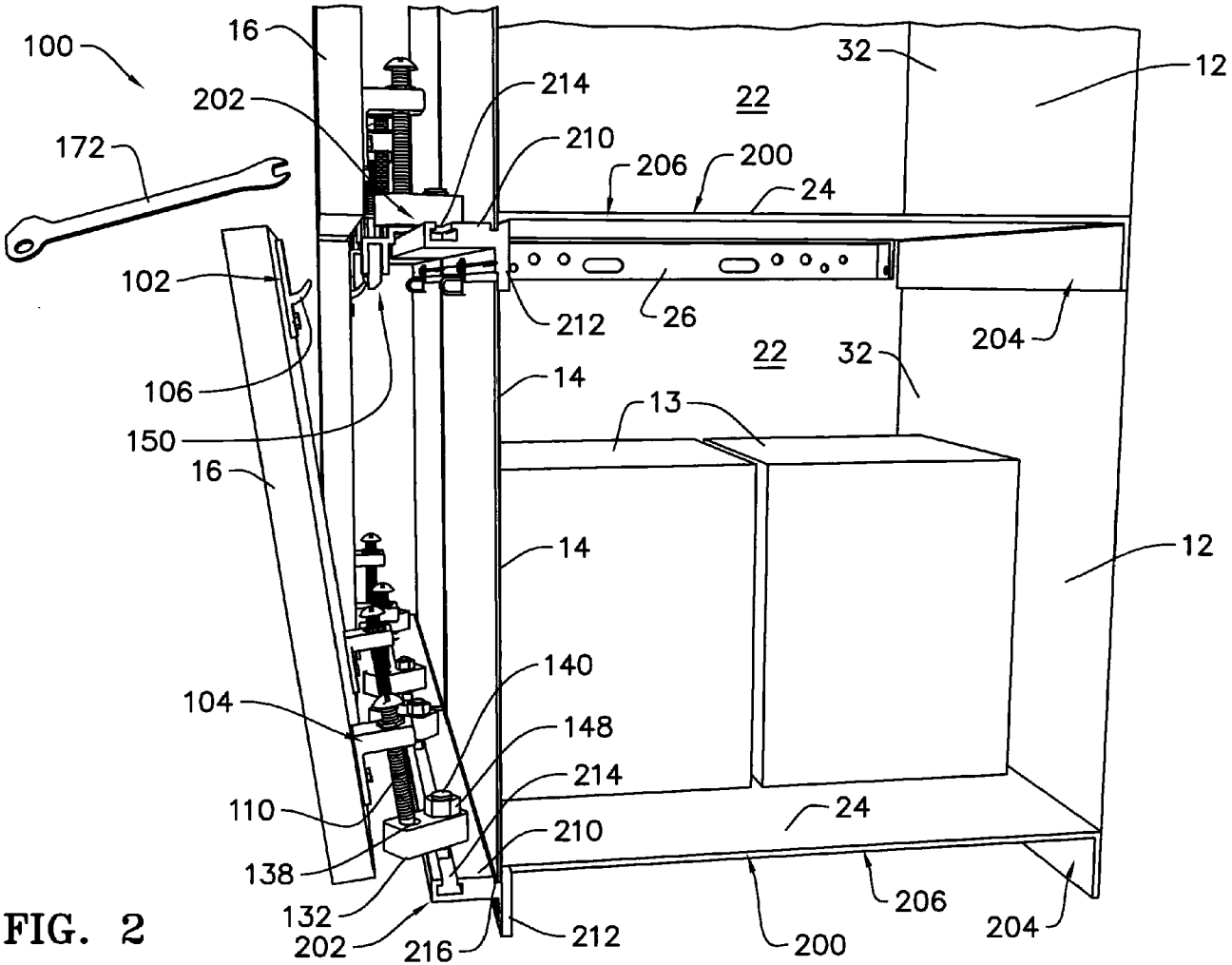
FIG. 2 is partial side perspective view of the columbarium of FIG. 1 showing a detailed view of the preferred embodiment of the concealed mounting system and horizontal member.
Figure 3:
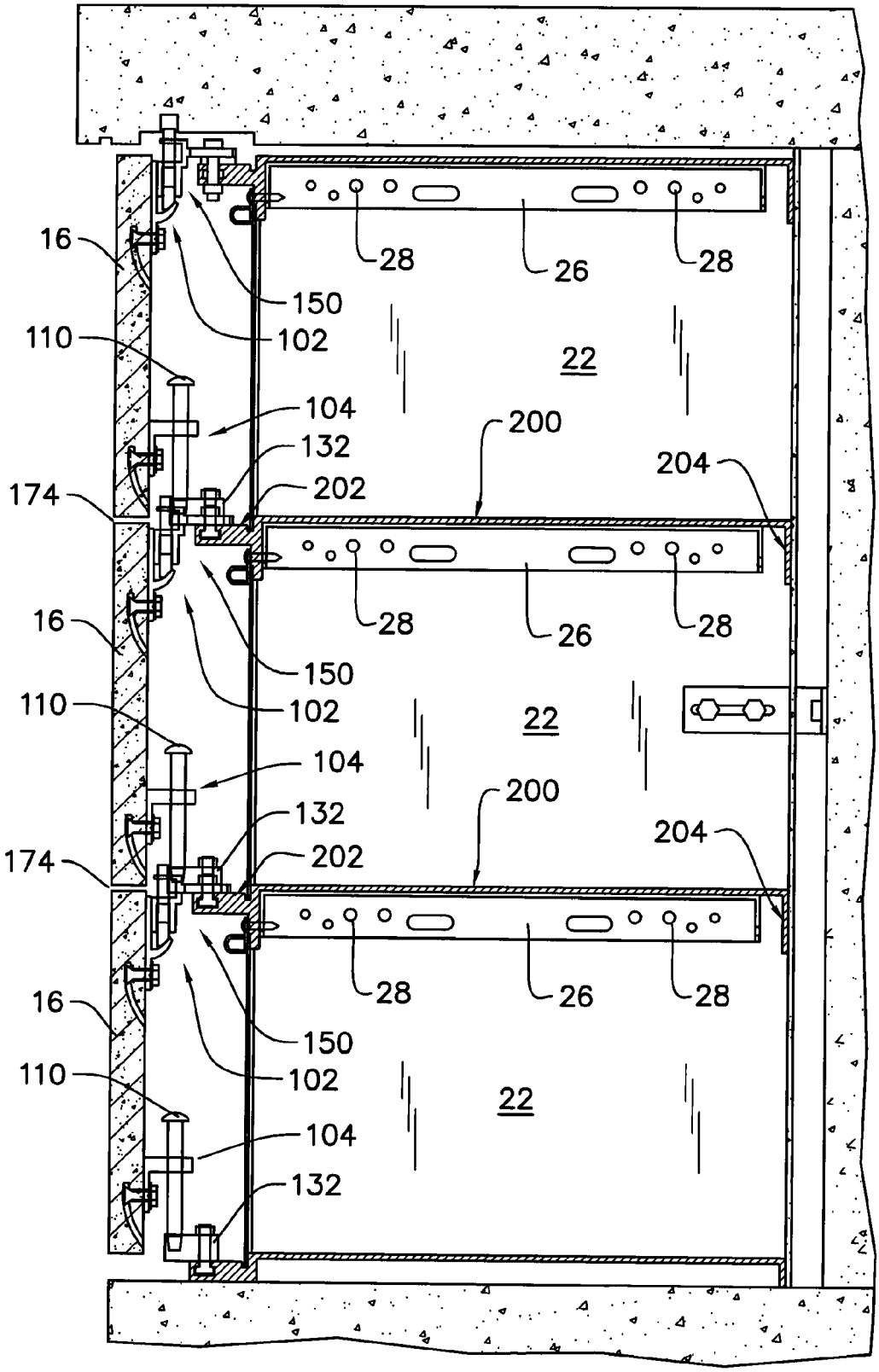
FIG. 3 is a cross-sectional view of the columbarium of FIG. 1 as viewed along lines 3-3 of FIG. 1.

As best illustrated in FIGS. 2-5, the front rail 202 of the horizontal member 200 includes a forwardly projecting flange 208 having a top surface 210 offset a distance downwardly from the top surface of the web 206. The front rail 202 also includes a downwardly projecting flange 212. A top channel 214 and a top slot 216 are also formed along the length forwardly projecting flange 208. Referring to FIG. 3, when two horizontal members 200 are disposed in vertical spaced relation, the top slot 216 of the lower horizontal member 200 is vertically aligned with the front face of the downwardly projecting flange 212 of the upper horizontal member 200 so that the inner closure panel 14 is substantially vertical. As best viewed in FIGS. 4 and 5, a turn tab 218 is pivotally secured to the downwardly projecting flange 212 by a threaded connector or rivet 220 to hold the top edge of the inner closure panel 14 in position, while the bottom edge of the inner closure panel 14 is received in the top slot 216. To remove the inner closure panel, the turn tab 218 is rotated up to free the top edge of the inner closure allowing the top edge to tilt forwardly so it can be grasped and lifted from the top slot 216 of the lower horizontal member 200.

Referring to FIGS. 2-7, the concealed mounting system 100 preferably includes an upper clip 102 and at least one, preferably two, lower support hangers 104 secured to the back side of the shutter 16. The upper clip 102 preferably includes an upwardly curving hook 106 that receives and is engaged by the upper lock 150 (described in greater detail later). The lower support hangers 104 preferably comprise an L-shaped bracket 108 with threaded studs 110 threadably received through a threaded apertures 112 in the rearwardly projecting leg 114 of the L-shaped bracket 108. The upper clip 102 and hangers 104 are preferably fabricated from extruded aluminum or other suitably rigid, weather resistant and dimensionally stable, extrudable or pultrudable material.

Figure 4:
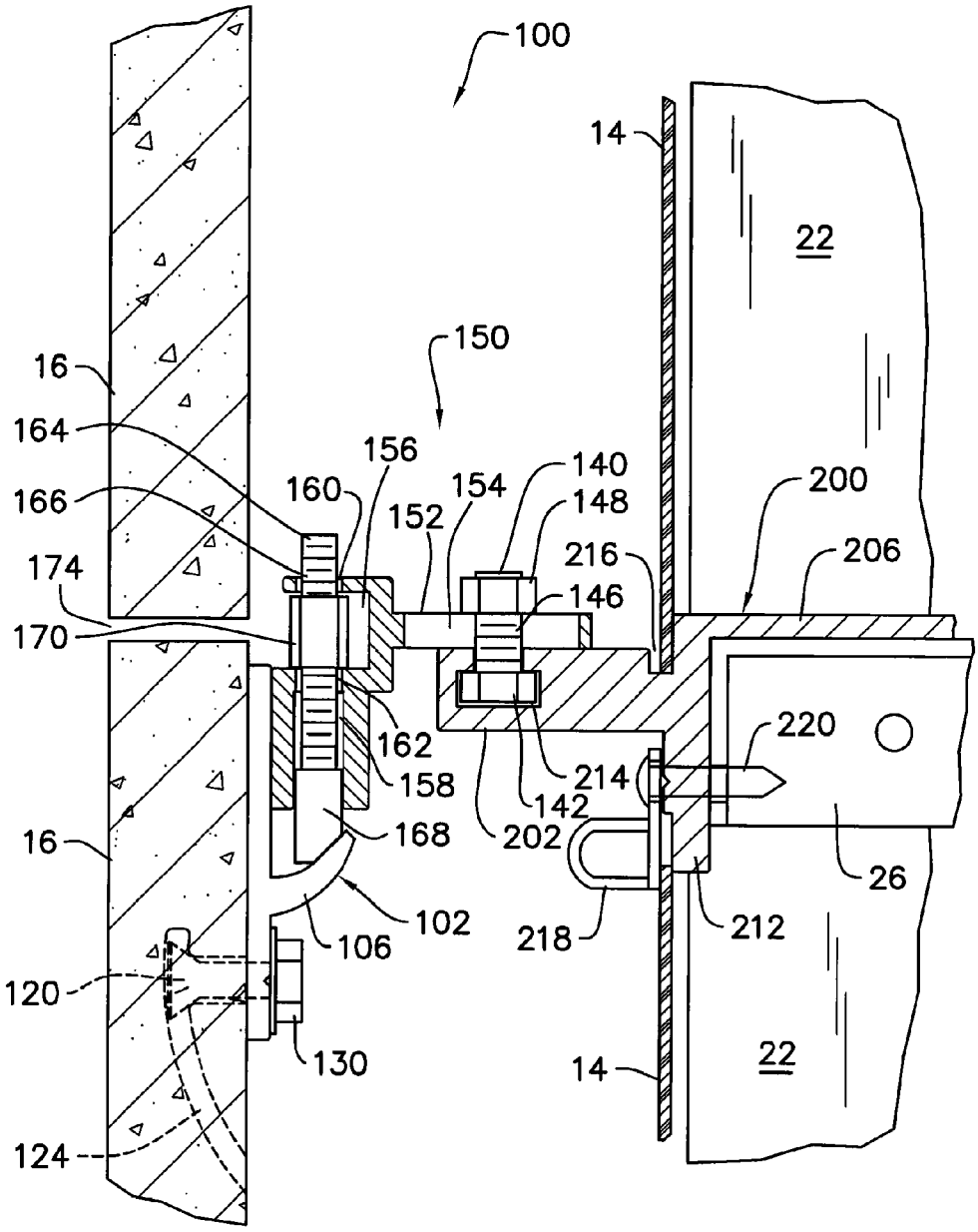
FIG. 4 is an enlarged view of the area circled in FIG. 3 showing in detail the preferred embodiment of the bottom hanger and swivel socket of the concealed mounting system.
Figure 5:
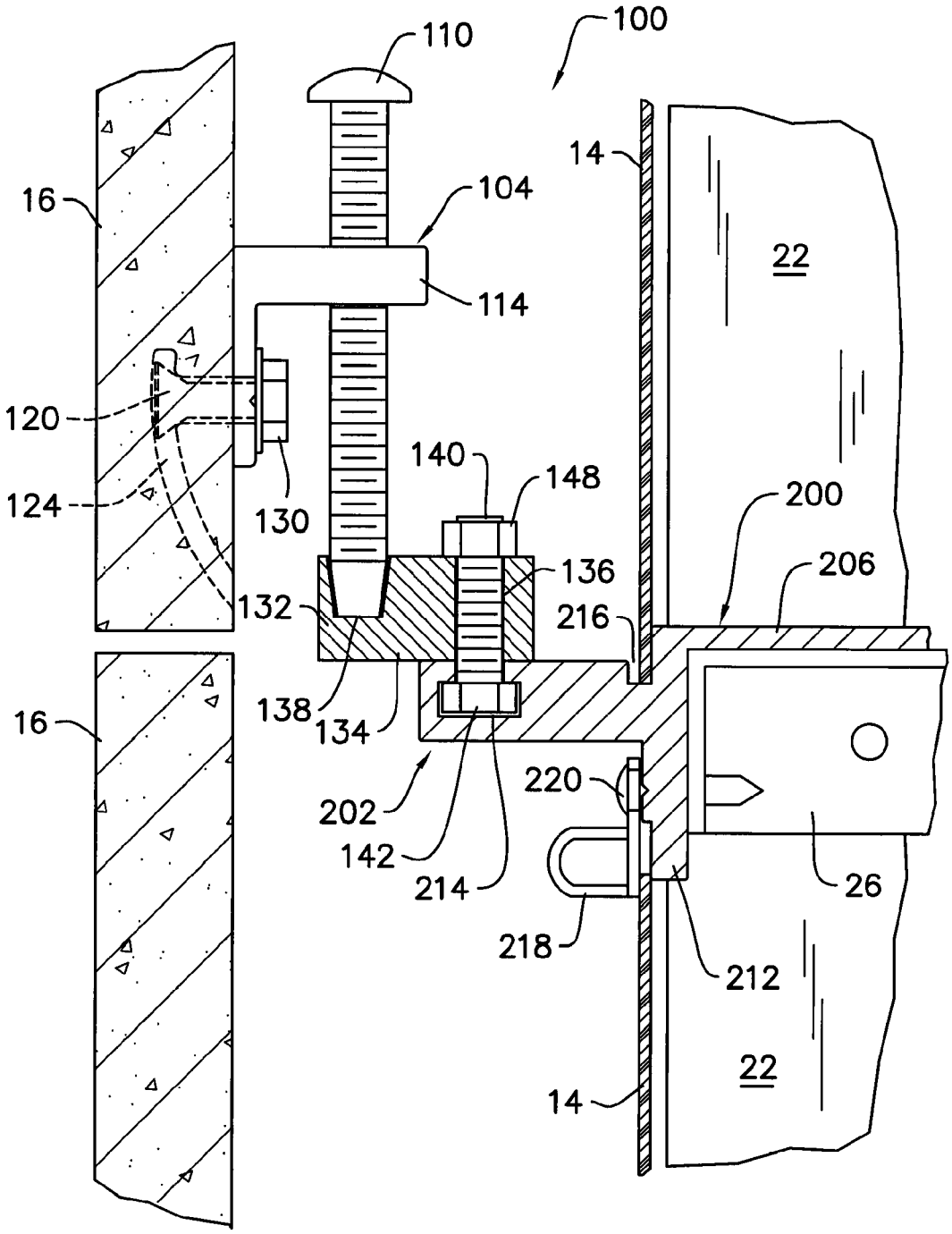
FIG. 5 is an enlarged view of the other area circled in FIG. 3 showing in detail the preferred embodiment of the upper clip and upper lock of the concealed mounting system.
Figure 6:
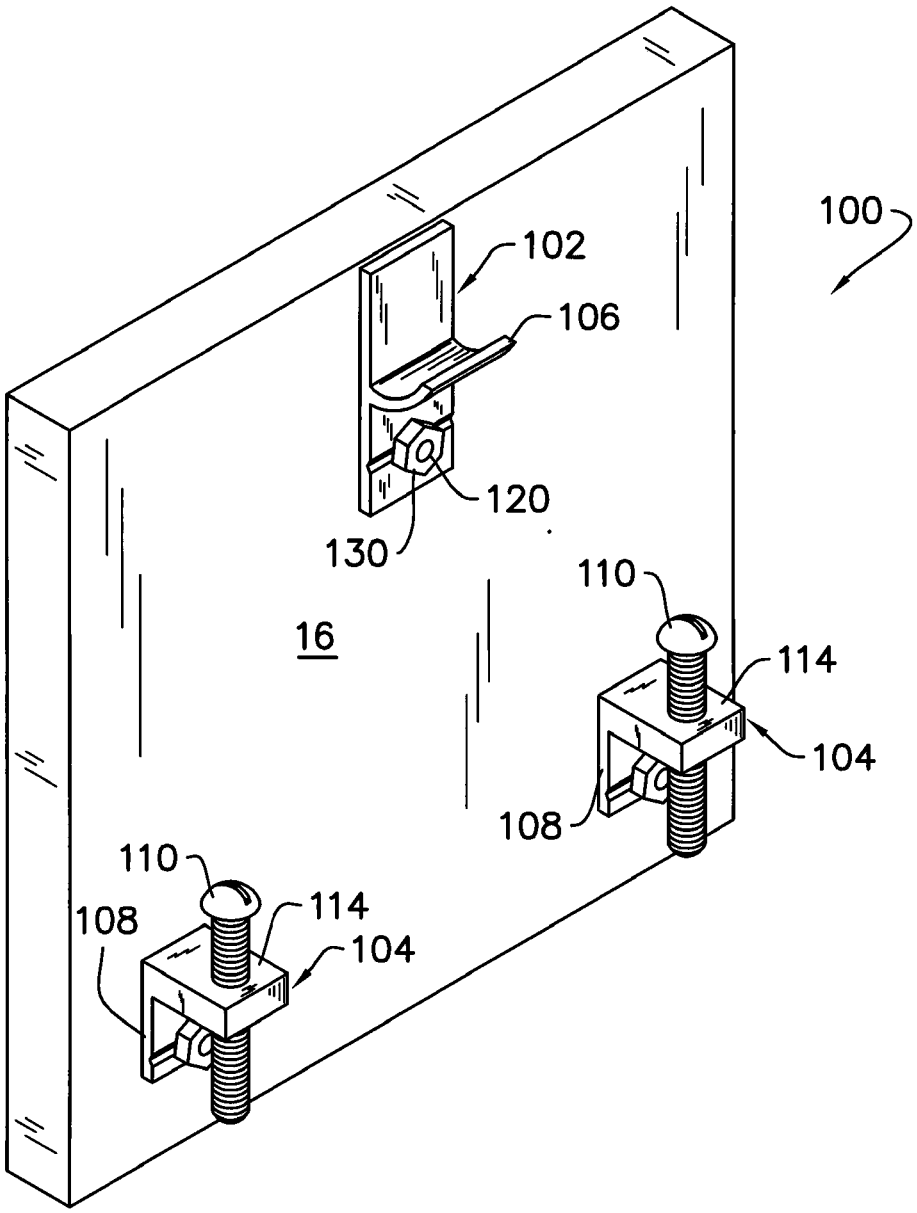
FIG. 6 is a rear perspective view of a shutter illustrating a portion of the preferred embodiment of the concealed mounting system secured to the back side of the shutter.
Figure 7:
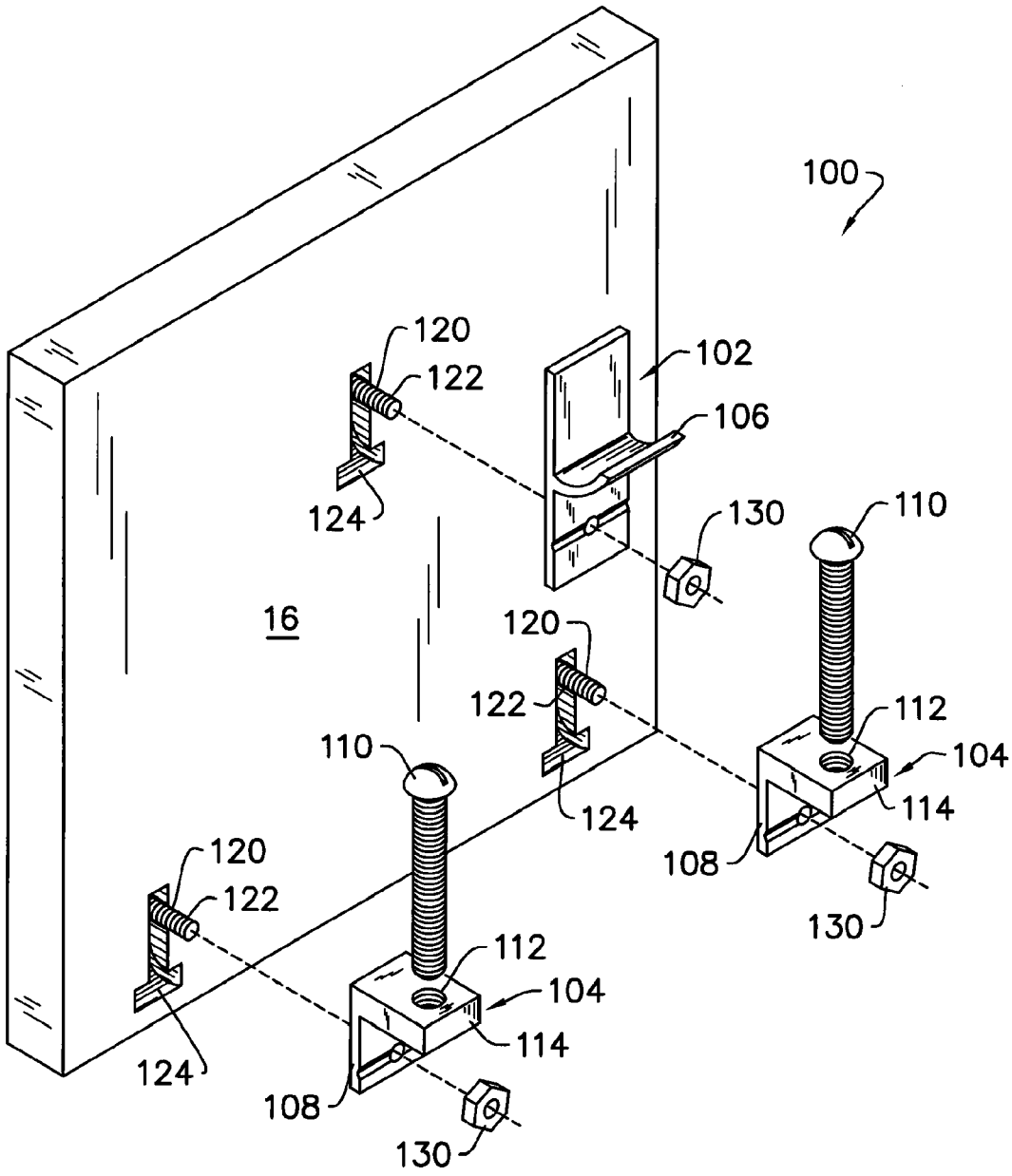
FIG. 7 is an exploded perspective view of the shutter and portion of the concealed mounting system of FIG. 6 and illustrating the slots fabricated into the back side of the shutter to receive the anchors.

In the preferred embodiment, as best illustrated in FIGS. 4, 5 and 7, the clip 102 and hangers 104 are secured with threaded anchors 120. The heads 122 of the threaded anchors are received within inverted T-shaped slots 124 cut into the back side of the stone such as disclosed in U.S. Pat. No. 4,020,610, which is incorporated herein in its entirety by reference. The threaded shaft 126 of the anchors 120 project from the back face of the shutter 16 and are received through apertures 128 in the clips 102 and hangers 104. A nut 130 is threaded onto the projecting threaded shaft 126 and are preferably tightened to approximately 95 in-pounds of torque to securely attach the clips 102 and hangers 104 in place and to prevent their rotation.

The preferred concealed mounting system 100 further includes at least one hanger support 132, preferably two, for cooperatively receiving and supporting the threaded stud 110. The hanger support 132 preferably comprises a swivel socket with an elongated body 134 having an aperture 136 near one end and a socket or indentation 138 at an opposite end. The swivel socket 132 is slidably positioned along the front rail 202 of the horizontal member 200 by a threaded lug 140 having a head 142 received within the top channel 214 of the front rail 202. The shaft 144 of the lug 140 extends through the top channel 214 and into the aperture 146 of the swivel socket 132 and is secured by a nut 148. By loosening and tightening the nut 148, the swivel socket 132 can pivot or swivel about the lug 140 and can be slidably, adjustably, fixably positioned anywhere along the length of the top channel 214 in order to align the socket 138 to receive the downwardly extending threaded stud 110. By turning the threaded stud 110 clockwise or counterclockwise it will cause the shutter 16 to raise or lower, respectively, relative to the swivel socket 132 and front rail 202 thereby providing vertical adjustment of the shutter 16. Likewise, by loosening and tightening the nut 148 on the lug 140, the swivel socket 132 can pivot inwardly or outwardly relative to the front rail 202 thereby providing in-and-out or fore-and-aft adjustment at the bottom of the shutter 16.

The concealed mounting system 100 also preferably includes an upper lock 150. The upper lock 150 includes a rearwardly projecting flange 152 having an elongated slot 154. Similar to the swivel sockets 132, the upper lock 150 is slidably positioned along the front rail 202 of the horizontal member 200 by a threaded lug 140 having a head 142 received within the top channel 214 of the front rail 202. The shaft 144 of the lug 140 extends through the top channel 214 and into the elongated slot 154 of the rearwardly projecting flange 152. By loosening and tightening the nut 148 threaded over the shaft 144 of the lug 140, the upper lock 150 can be positioned inwardly or outwardly relative to the front rail 202 thereby providing in-and-out or fore-and-aft adjustment at the top of the shutter. Furthermore, by loosening and tightening the nut 148 on the lug 140 the upper lock can be slidably, adjustably, fixably positioned at the desired location along the channel 214. This lug and nut configuration avoids the need to drill a hole through the front rail required for the locking screw in the '529 application. Additionally, because the lugs 140 of the top lock 150 and bottom hanger supports 132 use the same channel, the front rails has a simpler cross-section and requires less material than the front rail disclosed in the '529 application.

The preferred upper lock 150 includes a forwardly extending channel 156, and a downwardly extending channel 158. Apertures 160, 162 extend through the forwardly extending channel 156 and downwardly extending channel 158, respectively. A locking screw 164 passes through both apertures 160, 162. The locking screw 164 includes a threaded upper shaft 166 and a rectangular lower shaft 168. The threaded upper shaft 166 is threadably received by a nut 170 disposed within the forwardly extending channel 156. The nut 170 is larger than the diameter of the apertures 160, 162 such that the locking screw 164 is vertically supported within the forwardly extending channel 156 by the nut 170. The width of the rectangular lower shaft 168 of the locking screw is preferably only slightly less than the width between the legs of the downwardly extending channel 158 such that the rectangular lower shaft 168 prevents the locking screw 164 from rotating within the channel 158.

As best illustrated in FIG. 2, the nut 170 is accessible for rotation by an open end wrench 172 (FIG. 2) inserted in the gap 174 between vertically adjacent shutters 16. It should be appreciated that because the cooperation of the rectangular lower shaft 168 within the downwardly extending channel 158 prevents the locking screw 164 from rotating. Upon turning the nut 170 clockwise using the wrench 172, the locking screw 164 is caused to move downwardly allowing the end of the rectangular lower shaft 168 to engage the upwardly curving hook 106 of the upper clip 102. Likewise, by rotating the nut 170 counter-clockwise using the wrench 172, the locking screw 164 is caused to move upwardly thereby disengaging the end of the rectangular lower shaft 168 from the upward hook 106 of the clip 102 and allowing the shutter 16 to be easily removed for access to the niche 12. The end of the rectangular lower shaft 168 is preferably beveled to better mate with the upwardly curving hook 106.

Figure 8:
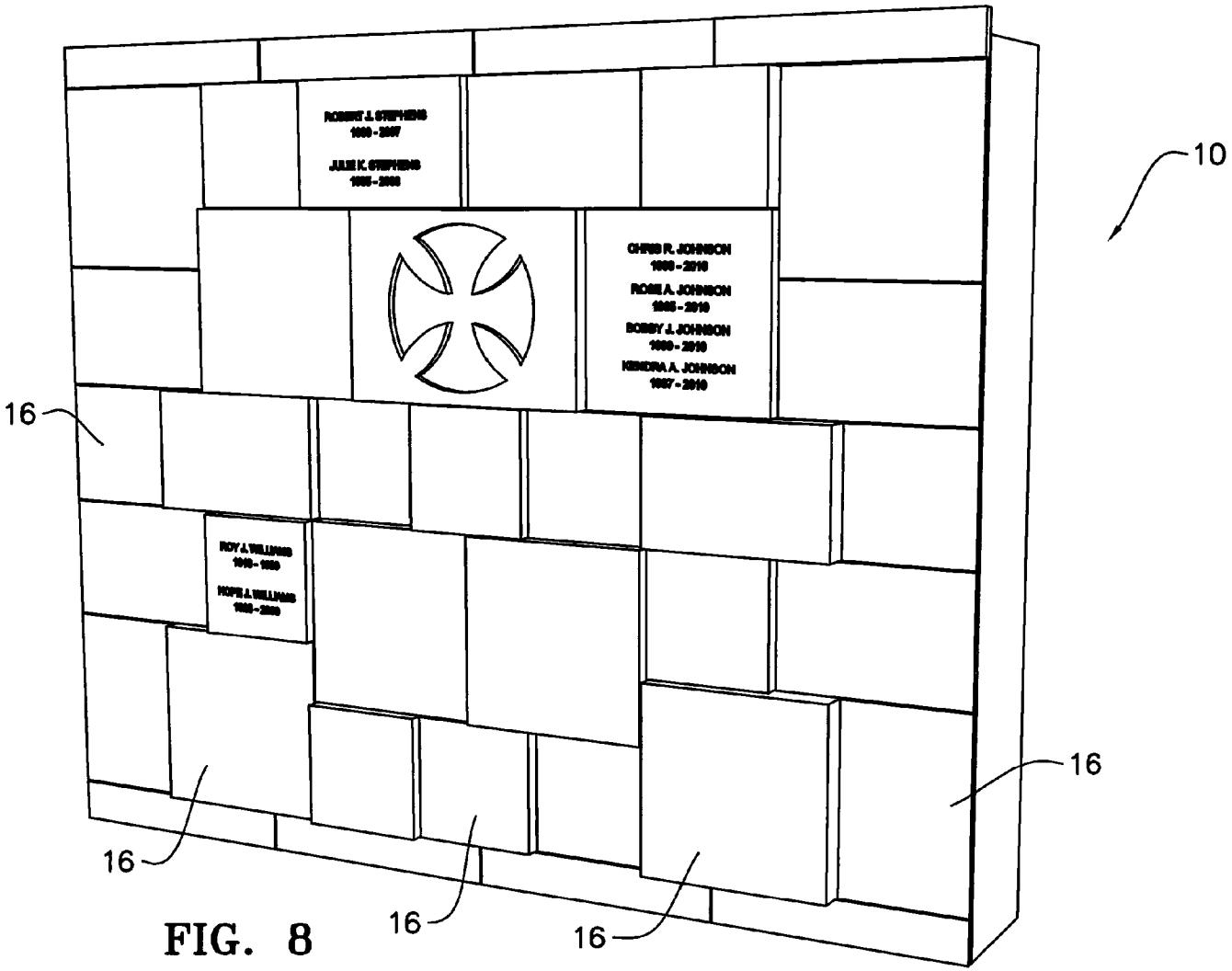
FIG. 8 is a perspective view of a columbarium with an example of a relief pattern to show how different size facing stones and different thicknesses of stones can be used with the concealed mounting system of the present invention to create different mosaics and relief patterns.

The in-and-out adjustment capability at the top of the shutter when combined with the in-and-out adjustment capability at the bottom of the shutter, allows for easier and faster installation of shutters and better accommodates different shutter thicknesses, whether due to thickness tolerances or inconsistencies in the stone or whether different stone thicknesses are being used to create a relief pattern such as shown in FIG. 8. Furthermore, it should be appreciated that once the nut 148 is tightened down, the swivel sockets 132 and the top lock 150 are prevented from pivoting or sliding horizontally within the top channel 214. Thus, if the facing stone or shutter 16 is ever removed, when it comes time to replace the shutter, the threaded studs 110 will be guided to seat in the bottom of the sockets 138 of the swivel socket 132 and the top lock 150 will cooperate to ensure that the shutter is returned to the exact same position before it was removed thereby avoiding the tedious task of having to readjust the shutter to ensure a uniform gap with the adjacent shutters.

As shown in FIG. 1, It should also be appreciated that through the pivotable movement of the swivel sockets 132, and with the centrally positioned upper lock 150, the shutter is capable of pivoting about a vertical Y axis as indicated by arrow 180. Furthermore, with threaded studs 110 received within the swivel sockets 132, and with the curvature of the upper clip cooperating with the upper lock 150, the shutter is also able to pivot about a horizontal X axis as indicated by arrow 182. Also, with the independent vertical adjustability of the threaded studs 110 cooperating with the swivel sockets, the shutter is also able to pivot about the Z axis as indicated by arrow 184. Thus, the shutter 16 is capable of being adjustable in three dimensions or about three axes of rotation, thereby enabling infinite adjustment of the shutters 16 to ensure uniform gaps are maintained between adjacent shutters for a more pleasing aesthetic appearance and to ensure the front of adjacent shutters are flush if desired, or as illustrated in FIG. 8, to allow adjacent shutters to be moved in or out to create a relief pattern if desired.

As shown in FIG. 8, it should also be appreciated that the concealed mounting system 100 allows more versatility than current shutter mounting systems by allowing the upper clips 102 and hangers 104 on the back of the shutters 16 to have varying positions between adjacent shutters and it allows for the shutters 16 to be placed anywhere along the front rail. This versatility will permit different sized niche fronts to be used along the columbarium wall thereby avoiding the post-office-box look that is often created when an entire columbarium wall comprises a grid of 8"×8" shutters. For example, the mounting system 100 will easily allow 8"×8" single niche shutters to be positioned adjacent 8" high×16" wide shutters or vertical 16" high×8" wide shutters or 12"×12" shutters or 24"×24" panels as desired. Accordingly, the mounting system 100 will allow more versatility in the configuration of niche fronts to create embellishments and introduce more and different types of stone mosaic patterns.

The foregoing hardware and components comprising the concealed locking system are preferably made of corrosion resistant material such as stainless steel, brass or aluminum or plated with a corrosion resistant finish and are preferably galvanically compatible with the other components to which they come into contact to minimize oxidation or corrosion so they remain capable of supporting the loads anticipated for the structure and withstanding extreme environmental conditions to which they may be subject.

It should be appreciated that the concealed mounting system 100 and cooperating horizontal member 200 may have application outside the internment industry where a concealed mounting system is desired for security or aesthetic reasons. For example, the concealed mounting system 100 and cooperating horizontal member 200 may be used in building structures that require removable wall panels. Another application may be for removably securing protective panels over windows of buildings or houses for protection from hurricanes or high winds. The foregoing mounting system 100 is equally suitable for fixed wall panels, where, once mounted, there may never be a need to remove the panel. Other applications may include the commercial sign industry where a concealed hardware is desirable to deter vandals and allow easy change-out of signs, advertisements, tenant directories, etc.

The foregoing description is presented to enable one of ordinary skill in the art to make and use the invention and is provided in the context of a patent application and its requirements. Various modifications to the preferred embodiment of the apparatus, and the general principles and features of the system and methods described herein will be readily apparent to those of skill in the art. Thus, the present invention is not to be limited to the embodiments of the apparatus, system and methods described above and illustrated in the drawing figures, but is to be accorded the widest scope consistent with the spirit and scope of the appended claims.

The invention claimed is:

1. A columbarium, comprising:

a framework of a plurality of horizontally spaced vertical risers and a plurality of vertically spaced horizontal members defining a plurality of niches arranged in substantially horizontal rows and substantially vertical columns;

each of said horizontal members having a substantially planar web extending between a front rail and a back flange;

a plurality of shutters disposed over said plurality of niches, each of said shutters having a top edge, a bottom edge, left and right side edges, a front face and a back face;

a concealed mounting system for removably mounting each of said plurality of shutters to said horizontal members, said concealed mounting system for each of said plurality of shutters comprising an upper clip, an upper lock, at least one bottom hanger and at least one bottom hanger support, said upper clip and said at least one bottom hanger secured to said back face of said shutter, said upper lock supported by an upper horizontal member, said at least one bottom hanger support supported by a lower horizontal member;

whereby said upper clip cooperates with said upper lock and said at least one bottom hanger support cooperates with said at least one bottom hanger such that each of said plurality of shutters is capable of being movable about three axes of rotation as well as vertically and horizontally with respect to said horizontal members.

2. The columbarium of claim 1 wherein said risers comprise cement board.

3. The columbarium of claim 1 wherein said risers comprise pultruded fiber reinforced polymer.

4. The columbarium of claim 2 wherein said horizontal members comprise extruded aluminum.

5. The columbarium of claim 2 wherein said horizontal members comprise pultruded fiber reinforced polymer.

6. The columbarium of claim 3 wherein said horizontal members comprise extruded aluminum.

7. The columbarium of claim 3 wherein said horizontal members comprise pultruded fiber reinforced polymer.

8. The columbarium of claim 1 wherein each of said plurality of shutters is approximately the size of each of said niches, whereby said shutters are arranged in horizontal rows and vertical columns corresponding to said horizontal rows and vertical columns of said niches.

9. The columbarium of claim 1 wherein said plurality of shutters include a first size shutter and a second size shutter, said first size shutter having a size approximately the size of a single one of said plurality of niches, said second size shutter having a size approximately the size of at least two adjacent shutters.

10. The columbarium of claim 9 wherein said at least two adjacent shutters include horizontally adjacent shutters and vertically adjacent shutters.

11. The columbarium of claim 9 wherein said first size shutters and said second size shutters are combined and arranged in a pattern.

12. The columbarium of claim 1 wherein said framework includes horizontal tie rods extending substantially parallel with said horizontal members and substantially perpendicular to said risers, said tie rod ends received by shelf brackets extending substantially parallel with said risers and substantially perpendicular to said horizontal members.

13. The columbarium of claim 1 wherein said front rail includes a top channel extending along a length of said horizontal member and wherein said upper lock is slidably, adjustably, fixable along said top channel.

14. The columbarium of claim 1 wherein said upper lock is adjustably, fixable in a direction transverse to said top channel.

15. The columbarium of claim 13 wherein said at least one bottom hanger support is slidably, adjustably, fixable along said top channel.

16. The columbarium of claim 15 wherein said at least one bottom hanger includes a threadably adjustable stud and wherein said at least one bottom hanger support is a swivel socket having a socket at one end to receive said threadably adjustable stud.

17. A panel mounting system, comprising:

an upper clip and at least one bottom hanger secured to a back side of a panel;

vertically spaced upper and lower rails disposed behind said panel at an upper end and a lower end of said panel;

an upper lock slidably, adjustably, fixable along said upper rail, said upper lock having a locking screw received within apertures disposed substantially perpendicular to a forwardly extending channel, said locking screw having a threaded upper shaft and a rectangular lower shaft, said threaded upper shaft threadably received and supported by a nut disposed in said forwardly extending channel, said rectangular lower shaft received by a downwardly extending channel, whereby upon rotation of said nut, said locking screw is caused to move vertically with respect to said upper clip for engagement and disengagement therewith;

at least one bottom hanger support slidably, adjustably, fixable along said lower rail and supporting said at least one bottom hanger.

18. The panel mounting system of claim 17 wherein said upper lock is adjustably, fixable in a direction transverse to said upper rail.

19. The panel mounting system of claim 17 wherein said upper clip and said at least one bottom hanger are secured to said back side of said panel with threaded anchors, each of said threaded anchors having a head received within an inverted T-shaped slot formed in said back side of said panel, a nut threaded onto each of said projecting threaded anchors secures said upper clip and said at least one bottom hanger to said back side of said panel by causing said anchor heads to be frictionally engaged with said slots.

20. The panel mounting system of claim 17 wherein each of said rails further includes a top channel and said at least one bottom hanger includes a threadably adjustable stud, wherein a bottom end of said stud is received within a socket of a swivel socket, said swivel socket is slidably adjustable along said top channel of said lower rail.

* * * * *